United States Patent [19]

Tabor et al.

[11] Patent Number: 5,051,351

[45] Date of Patent: Sep. 24, 1991

[54] DYE POLYMERS

[75] Inventors: Derrick C. Tabor, Rochester; Mridula Nair, Penfield, both of N.Y.

[73] Assignee: Eastman Kodak Company, Rochester, N.Y.

[21] Appl. No.: 369,792

[22] Filed: Jun. 22, 1989

[51] Int. Cl.[5] ..... G03C 1/10; G03C 1/12

[52] U.S. Cl. ..... 430/570; 430/576; 430/583

[58] Field of Search ..... 430/570, 585, 588, 572, 430/583, 576

[56] References Cited

U.S. PATENT DOCUMENTS

| | | |
|---|---|---|
| T896,035 | 3/1972 | Rauner et al. . |
| 2,393,351 | 1/1946 | Wilson et al. . |
| 2,425,772 | 8/1947 | Wilson . |
| 2,425,773 | 8/1947 | Wilson . |
| 2,425,774 | 3/1949 | Wilson . |
| 2,465,412 | 3/1949 | Wilson . |
| 2,639,282 | 5/1953 | Sprague et al. . |
| 3,073,699 | 1/1963 | Firestine . |
| 3,369,904 | 2/1968 | Faber . |
| 3,622,317 | 11/1971 | Bird et al. . |
| 3,976,493 | 8/1976 | Borror et al. . |
| 4,040,825 | 8/1977 | Steiger et al. . |
| 4,138,551 | 2/1979 | Steiger et al. . |

OTHER PUBLICATIONS

Smets & Simionescu, Polymer Induced Aggregation of Dye Molecules, Influence of the Attachment of Dye Molecules as Side Groups, Jan. 1977, pp. 2719–2723.

Steiger & Reber, Gelatin-Substituted Cyanine Dyes as Spectral Sensitizers for Silver Halide Emulsions, 1983, pp. 59–65.

Douy & Gallot, Amphipathic Block Copolymers with Two Polypeptide Blocks: Synthesis and Structural Study of Poly(N-Trifluoroacetyl-L-Lysine)-Polysarcosine Copolymers, 1985, pp. 147–154.

*Primary Examiner*—Charles L. Bowers, Jr.
*Assistant Examiner*—Mark R. Buscher
*Attorney, Agent, or Firm*—Andrew J. Anderson

[57] ABSTRACT

Dye copolymers are disclosed represented by the formula:

$$\text{-}(A)_x\text{-}(B)_y\text{-}(C)_z\text{-}$$

where A, B, C, D, x, y, and z are as defined herein. The dye polymers are useful as sensitizing dyes for silver halide in photographic compositions.

7 Claims, No Drawings

DYE POLYMERS

FIELD OF THE INVENTION

This invention relates to dyes, specifically to sensitizing dyes for photographic compositions.

BACKGROUND OF THE INVENTION

Spectral sensitization of silver halide in photographic compositions is generally accomplished by adsorption of sensitizing dye molecules to the surface of silver halide grains. The dye molecules absorb energy of a certain wavelength and transfer that energy to the silver halide, causing formation of a latent image. The use of dye polymers as sensitizing dyes for silver halide in photographic compositions has been proposed for a number of reasons. For example, U.S. Pat. No. 2,639,282 describes resin cyanine dyes that sensitize silver halide and are not subject to wandering in gelatin layers of photographic elements. U.S. Pat. application Ser. No. 239,864, now U.S. Pat. No. 4,950,587 filed Sept. 2, 1988, in the names of M. R. Roberts. D. C. Tabor, and P. B. Gilman, entitled "J-Aggregating Dye Polymers as Spectral Sensitizers for Silver Halide Photographic Compositions" describes dye polymers that J-aggregate when used to sensitize silver halide.

One problem with the successful use of dye polymers to sensitize silver halide in a wide variety of photographic compositions has been the low aqueous dispersibility of the dye polymers, which has led to difficulty in dispersing the dyes in hydrophilic photographic compositions and to objectionable stain caused by dye polymer retained in the element after processing. It would thus be advantageous to provide a dye polymer for sensitizing silver halide in photographic compositions that did not suffer from these problems.

SUMMARY OF THE INVENTION

The dye copolymers of the present invention are represented by the repeating formula:

$$\text{-}(A)_x\text{-}(B)_y\text{-}(C)_z\text{-} \qquad (I)$$

where B represents a 1 to 100 repeat unit block of amino acid monomer where at least 1 of the repeat units in each block are represented by $$\text{-}(B')\text{-}\atop{|\atop D}$$

with B' representing a polymerized amino acid monomer, C represents a 1 to 100 repeat unit block of an N-substituted amino acid monomer, A represents a 1 to 100 repeat unit block of one or more other monomers, D is a dye capable of spectrally sensitizing silver halide, x represents a mole percent of 0 to 20%, y represents a mole percent of 1 to 50%, and z represents a mole percent of 50 to 99%.

The dyes of formula (I) effectively sensitize silver halide in the intrinsic region, are readily dispersed in hydrophilic photographic silver halide emulsion compositions, and leave little residual dye stain in photographic elements after processing. When used in combination with conventional spectral sensitizing dyes (i.e., those not bonded to a polymer backbone), the dyes of formula (I) provide both intrinsic and spectral sensitization of silver halide.

DESCRIPTION OF THE PREFERRED EMBODIMENTS

The dye units of the dye polymer of the invention can be any of a number of well known cyanine or merocyanine sensitizing dyes. The cyanine dyes include, Joined by a methine linkage, two basic heterocyclic nuclei, such as those derived from quinolinium, pyridinium, isoquinolinium, 3H-indolium, benz[e]indolium, oxazolium, thiazolium, selenazolinium, imidazolium, benzoxazolinium, benzothiazolium, benzoselenazolium, benzimidazolium, naphthoxazolium, naphthothiazolium, naphthoselenazolium, thiazolinium dihydronaphthothiazolium, pyrylium, and imidazopyrazinium quaternary salts.

Merocyanine spectral sensitizing dyes include, Joined by a methine linkage, a basic heterocyclic nucleus of the cyanine dye type and an acidic nucleus, such as can be derived from barbituric acid, 2-thiobarbituric acid, rhodanine, hydantoin, 2-thiohydantoin, 4-thiohydantoin, 2-pyrazolin 5-one, 2-isoxazolin 5-one, indan 1,3-dione, cyclohexan 1,3-dione, 1,3-dioxan 4,6-dione, pyrazolin 3,5-dione, pentan-2,4-dione, alkylsulfonyl acetonitrile, malononitrile, isoquinolin-4-one, and chroman-2,4-dione.

The dyes useful in the invention may be cationic, anionic, or neutral. One advantage of the present invention is that it allows the use of cationic dyes without the unsensitization (i.e., sensitivity loss caused by displacement of spectral sensitizing dye adsorbed to the silver halide grains) that many cationic dyes often cause.

The chemistry of cyanine and related dyes, including methods of making them, is described by Weissberger and Taylor, *Spectral Topics of Heterocyclic Chemistry,* John Wiley and Sons, New York, 1977, Chapter VIII; Venkataraman, *The Chemistry of Synthetic Dyes,* Academic Press, New York, 1971, Chapter V; James, supra, Chapter 8, and F. M. Hamer, *Cyanine Dyes and Related Compounds,* John Wiley and Sons, New York, 1964. Useful sensitizing dyes include those disclosed in UK Patent 742,112, Brooker U.S. Pat. Nos. 1,846,300, '301, '302, '303, '304, 2,078,233, and 2,089,729, Brooder et al U.S. Pat. Nos. 2,165,338, 2,213,238, and 2,493,747, '748, 2,526,632, 2,739,964 (Reissue 24,292), 2,778,823, 2,917,516, 3,352,857, 3,411,916, and 3,431,111, Sprague U.S. Pat. No. 3,503,776, Nys et al U.S. Pat. No. 3,282.933, Riester U.S. Pat. No. 3,660,102, Kampfer et al U.S. Pat. No. 3,660,103, Taber et al U.S. Pat. Nos. 3,335,010, 3,352,680, and 3,384,486, Lincoln et al U.S. Pat. No. 4,397,981, Fumia et al U.S. Pat. Nos. 3,482,978, and 3,623,881, Spence et al U.S. Pat. No. 3,718,470, and Mee U.S. Pat. No. 4,025,349.

The sensitizing dye is covalently bonded to the polymer backbone through any atoms capable of forming such bonds. For example, covalent bonds between the dye and the polymer backbone may be formed through a heteroatom, such as the nitrogen atom of a heterocyclic nucleus of the dye.. It is within the skill of the art (see, e.g., U.S. Pat. No. 2,639,282) to bond a particular dye molecule and polymer backbone. For example, a dye may be bound to a polymer backbone by a substitution reaction (e.g., utilizing a nucleophile such as amino, hydroxy, alkoxy, alkylthio, and the like), an addition reaction (e.g., a Michael addition such as a reaction between an activated unsaturated group such as a vinyl sulfonyl or acryloyl with an active methylene group such as —CO—$CH_2$—CO—$CH_3$ or —CO—$CH_2$—CN), or a condensation reaction (e.g., the reaction of an amine or alcohol with a carboxylic acid or ester). These reactions may be between hydroxy compounds or amines, and isocyanates, carboxylic acids, carboxylic acid esters, carboxylic acid halides, carboxylic acid anhydrides, sulfonic acids, sulfonic acid esters, or sulfonic acid halides.

The bonding of the dye to the polymer backbone may be direct or through any known functional group, such as with a divalent hydrocarbon of from 4 to 15 carbon atoms, an ester (e.g., —$(CH_2)_2$—$CO_2$—$(CH_2)_2$—), amido (e.g., —$(CH_2)_3$—CO—NH—$(CH_2)_2$—), imido (e.g., —$(CH_2)_4$—N=CH—$(CH_2)_4$—), urethane (e.g., —$(CH_2)_5$—O—CO—NH—$(CH_2)_5$—), sulfonamido (e.g., —$(CH_2)_3$—$SO_2$—NH—$(CH_2)_3$—), or carbonate (e.g., —$(CH_2)_2$—O—CO—O—$(CH_2)_4$—).

Examples of formula (I) polymers include: -a-b-b-b-c-c-c-c-, -a-b-c-, -a-b-c-c-c-, -a-b-b-c-c-, -a-a-a-a-a-b-b-b-b-b-b-b-b-b-b-c-c-c-c-c-c-c-c-c-c-c-c-c-c-c-c-c-c-and, if x is 0, -b-c-c- and -b-b-b-b-c-c-c-c-. The lower case a, b, and c are used here to represent the individual repeat units that make up the generic upper case -A-, -B-, and -C- of formula (I).

According to formula (I), the compounds most useful as -A- are initiators for polymerization of the polymer. These include nucleophiles and bases. Examples of monomers useful as -A- include primary and secondary amines (e.g., n-hexylamine, diethylamine), aprotic bases (e.g., thiols, NaOH, $NaOCH_3$,), and amino acid esters (e.g., methionine methyl ester, methyl glutamate, methyl glycinate).

According to formula (I), -B- represents a block containing 1 to 100 repeat units of amino acid monomer. At least 1 of the repeat units in this block are dye carrying repeat units described above as B' repeat units. These are identical to the other repeat units in the block except they have dye molecules appended thereto. In a preferred embodiment, the -B- monomers are α-amino acids. Examples of monomers useful for as -B- include serine, theronine, tyrosine, hydroxy proline, aspartic acid, glutamic acid, lysine, arginine, ornithine, and histidine, and the like.

Also according to formula (I), C represents a block containing 1 to 100 repeat units of an N-substituted amino acid monomer. Examples of monomers useful as -C- include any N-substituted amino acid (e.g., sarcosine, N-methyl valine, N-methyl phenylglycine, abrine, surinamine).

The sensitizing dye, D, can be any of the sensitizing dyes described above. In a preferred embodiment, -D is represented by the formula -D'-D", where D' is a dye intermediate capable of bonding with a side chain of the polymer backbone and D" is a dye intermediate capable of bonding to D'.

Examples of -D' include:

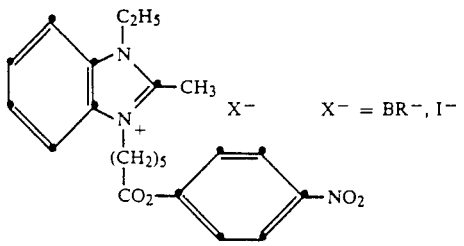

Examples of -D" include:

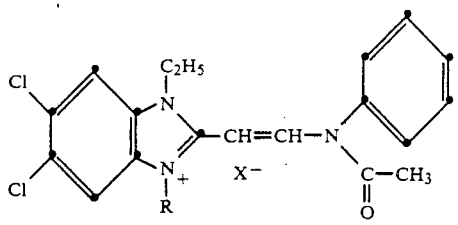

where $X^-$is $I^=$, $Br^-$, or p-toluene sulfonate and R is ethyl, methyl, propyl, butyl, pentyl, hexyl, heptyl, nonyl, decyl, —$(CH_{24}$—N—$(C_2H_5)_3^+$ $Br^-$, or —$(CH_2)_5$—N—$(C_2H_5)_3$+$Br^-$. Additional examples of such dye intermediates and how they are incorporated in the dye polymer are shown in the Examples below.

The -B- block of formula (I) as well as the polymer of formula (I) itself can be prepared by techniques known to those skilled in the art (e.g., as described, for example in U.S. Pat. No. 2,639,282) or by the techniques described in U.S. Pat. application No. 07/239,864. In polymers where x is 0 and no -A- initiator monomer is present, an initiator that does not become part of the polymer can be used to initiate polymerization. Such initiators are known to those skilled in the art and include, for example, tertiary amines (e.g., triethylamine) and $\phi_3CNa$. An example of the reaction scheme used to prepare a typical dye polymer useful in the invention is shown in the Examples below.

The dye polymers useful in the practice of the invention can be used to sensitize silver halide in essentially any known form, such as conventional silver halide and gelatin emulsions as described in *Research Disclosure,* Item 17643, December, 1978 [hereinafter referred to as *Research Disclosure I*], tabular grain silver halide and gelatin emulsions as described in *Research Disclosure,* Item 22534, January, 1983, and pure silver halide such as vacuum deposited silver halide layers or degelled silver halide grains. For spectral sensitization of silver halide and gelatin emulsions, it is especially useful to dissolve the dye polymer in a polar organic solvent, such as methanol, and then add the dye solution to an aqueous silver halide emulsion.

The dye polymer of formula (I) may be used by itself to sensitize silver halide in the intrinsic region, or it may be used in combination with other polymeric sensitizing dyes or conventional sensitizing dyes to spectrally sensitize silver halide. Such combinations may provide the silver halide with sensitivity to broader or different ranges of wavelengths of light than silver halide sensitized with a single dye polymer. Combinations of polymeric dyes, non polymeric dyes, or both, may provide supersensitization of spectrally sensitized silver halide.

In a preferred embodiment, the dye polymer of formula (I) is present in a silver halide emulsion in combination with one or more spectral sensitizing dyes not appended to a polymer backbone. These other spectral sensitizing dyes preferably have the same heterocyclic nuclei as used in the dye polymer of formula (I). Alternatively, the dye polymer and the spectral sensitizing dye(s) can have different heterocyclic nuclei.

One advantage of the dye polymers of formula (I) is that they provide reduced dye stain in photographic elements compared to prior art dye polymers. One factor affecting the level of dye stain for elements using dye polymers of formula (I) is on the ratio of -D- units in the polymer compared to the number of -C- units in the polymer. The D:C molar ratio is preferably about 1:1 to about 1:100,000 and more preferably from about 1:100 to about 1:5.

The amount of dye polymer of formula (I) in silver halide emulsions (as expressed in moles of dye units D per mole of silver) can be essentially any amount (even very small amounts, since the dye polymer of formula (I) can function as a chemical sensitizer of silver halide). This amount is preferably from about 0.0001 mmole to about 5 mmole per mole Ag and more preferably from about 0.004 mmole to about 0.015 mmole per mole Ag.

Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali treated gelatin such as cattle bone or hide gelatin, or acid treated gelatin such as pigskin gelatin), gelatin derivatives (e.g., acetylated gelatin), phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount known to be useful in photographic emulsions.

The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as illustrated in *Research Disclosure,* June, 1975, item 13452 and U.S. Pat. No. 3,772,031.

Other addenda include brighteners, antifoggants, stabilizers, filter dyes, light absorbing or reflecting pigments, vehicle hardeners such as gelatin hardeners, coating aids, dye-forming couplers, and development modifiers such as development inhibitor releasing couplers, timed development inhibitor releasing couplers, and bleach accelerators. In a preferred embodiment, the emulsion includes 2-phenoxyethanol as an additive. These addenda and methods of their inclusion in emulsion and other photographic layers are well known in the art and are disclosed in *Research Disclosure I* and the references cited therein.

The emulsion layer containing silver halide sensitized with the dye polymer of the invention can be coated simultaneously or sequentially with other emulsion layers, subbing layers, filter dye layers, or interlayers or overcoat layers, all of which may contain various addenda known to be included in photographic elements. These include antifoggants, oxidized developer scavengers, DIR couplers, antistatic agents, optical brighteners, light-absorbing or light-scattering pigments, and the like.

The layers of the photographic element can be coated onto a support using techniques well-known in the art. These techniques include immersion or dip coating, roller coating, reverse roll coating, air knife coating, doctor blade coating, stretch-flow coating, and curtain coating, to name a few. The coated layers of the element may be chill-set or dried, or both. Drying may be accelerated by known techniques such as conduction, convection, radiation heating, or a combination thereof.

The photographic element of the invention can be black and white or color. A color photographic element generally contains three silver emulsion layers or sets of layers: a blue-sensitive layer having a yellow color coupler associated therewith, a green-sensitive layer having a magenta color coupler associated therewith, and a red-sensitive layer having a cyan color coupler associated therewith. Other element configurations are well-known in the art and are disclosed, for example, in *Research Disclosure I.*

The invention is further illustrated by the following examples.

EXAMPLE 1

Step 1—Preparation of the N-carboxyanhydride of ε-trifluoroacetyl-l-lysine (Intermediate A)

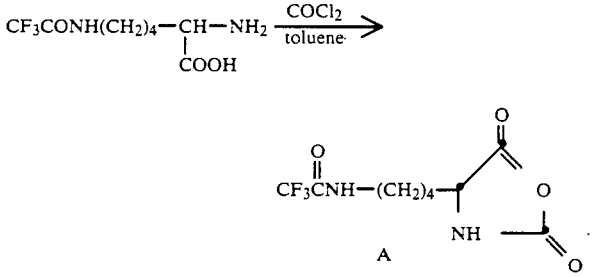

ε-trifluoroacetyl-1-lysine (5 g, 0.019 mol) was suspended in 25 cc of a 2.2M solution of phosgene in toluene. The mixture was heated at 50° C. for 2 hours or until almost all the solid material had dissolved. The resulting solution was filtered under argon and added to dry ligroin (250 ml) and cooled at −20° C. for 18 hours. The crystallized material was filtered under Argon, washed thoroughly with fresh ligroin and used immediately.

Yield 4.3 g, 76%.

m.p. 84°-86° C.

IR spectrum was consistent with assigned structure.

Step 2—Preparation of the N-carboxyanhydride of sarcosine

This compound was prepared according to the method cited in Biopolymers 1, 99 (1963) (G. D. Fasman and E. R. Blout), and recrystallized using ligroin until no chloride ions were detected (the presence of chloride ions was determined with silver nitrate).

m.p. 100°-102° C. (lit. 104°-105° C.)

IR spectrum was consistent with assigned structure.

Step 3—Preparation of block copolymers of methionine-(l-lysine)$_{20}$-(sarcosine)$_{60}$ (Intermediate B)

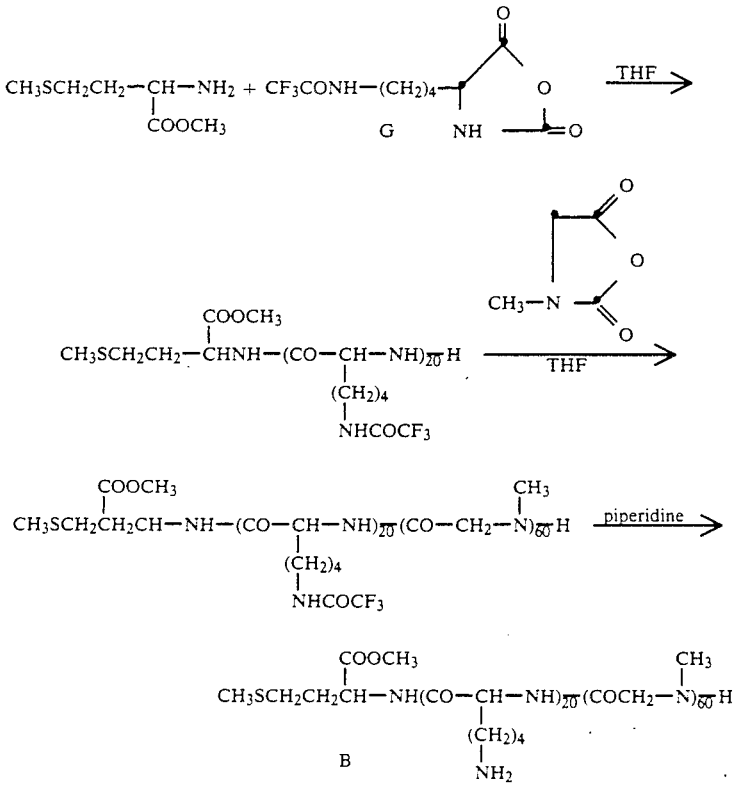

ε-trifluoroacetyl-l-lysine-N-carboxyanhydride (G, step 1, 1.8 g, $6.7\times10^{-3}$ moles) was dissolved in dry tetrahydrofuran (50 ml) and treated with methionine methyl ester (55 mg, $3.4\times10^{-4}$ moles) under argon at room temperature. The solution was stirred overnight (18 hours), and the polymerization reaction monitored by the disappearance of the N-carboxyanhydride peaks in the IR. Sarcosine-N-carboxyanhydride (step 2, 2.3 g, $2.0\times10^{-2}$ moles) in tetrahydrofuran (25 ml) was then added to the above solution and stirring was continued overnight (18 hours). After disappearance of all the remaining N-carboxyanhydride peaks (IR), the solution was filtered and solvent removed on a rotary evaporator at 40° C. The polymer was dispersed in 1M methanolic piperidine (37 ml) and stirred for 2 hours. To this was added 1M aqueous piperidine (30 ml) and the mixture was stirred for 24 hours, after which the initially cloudy solution turned clear. The solution was dialyzed for 2 days and then freeze-dried.

Yield 1.9 g, 88%.

{n}=0.1 (measured at a concentration of 0.25 g/dl in 0.05N HCL at 25° C.).

IR spectrum was found to be consistent with assigned structure.

Step 4-Preparation of 2-methyl-3-[5-p-nitrophenoxycarbonyl)pentyl]-benzthiazolium bromide (Intermediate C)

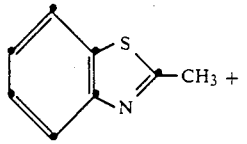

-continued

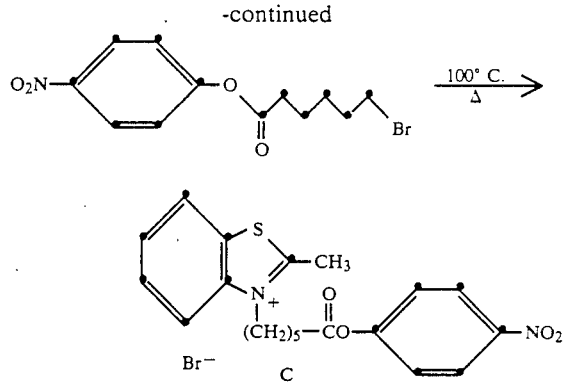

Benzothiazole (9.14 g, 61.3 mmol) and p-nitrophenyl-6-bromohexanoate (21 g, 66 mmol) were mixed and heated at 100° C. for 18 hours. The resulting product was cooled and crystallized from acetone. The crystals were filtered and washed twice with additional acetone and vacuum dried.

Yield 14.2 g, 50° m.p.205°-207° C.

IR and NMR were consistent with the assigned structure.

Elemental analyses calculated for $C_{20}H_{21}BrnN_2O_4S$: C 51.6, H 4.5, Br 17.2, N 6. Found: C 51.7, H 4.7, Br 17.2, N 6.2.

Step 5-Preparation of the cyanine dye (Intermediate D)

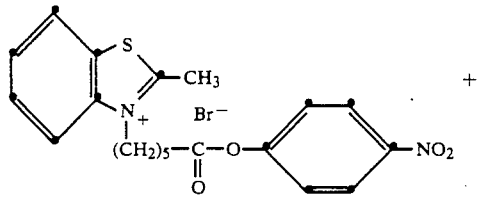

C

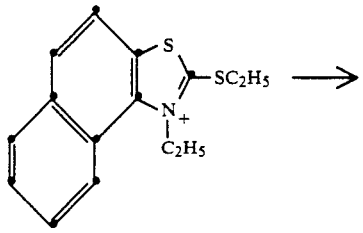

$C_2H_5OSO_3^-$

-continued

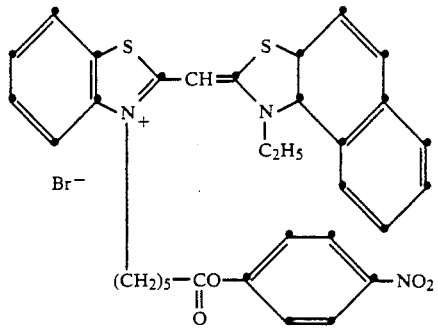

D

The p-nitrophenyl derivative (C) from step 4 (3.5 g, 7.5 mmol) was suspended in acetonitrile (50 ml) along with 2-(ethylthio)-3-ethyl naphthothiazolium ethanesulfonate (3.5 g, 7.5 mmol). To this was added triethyl amine (1.5 g) in acetonitrile (25 ml). The mixture was stirred for 30 minutes and the precipitated-dye filtered and washed with additional acetonitrile. The precipitate was filtered and dried in vacuum.

Yield 4.00 g, 80% m.p. 232°-233° C.

IR and NMR spectra were found to be consistent with the assigned structure.

Elemental analyses calculated for $C_{33}H_{30}BrN_3O_4S_2$: C 58.3, H 4.4, N 6.2, O 9.5, S 9.5. Found: C 58.1, H 4.3, N 6.0, O 10.7, S 9.6

$\lambda_{max}$ (MeOH)=440 nm $\epsilon=7.7\times10^4$

Step 6—Preparation of Dye-Polymer DP-2

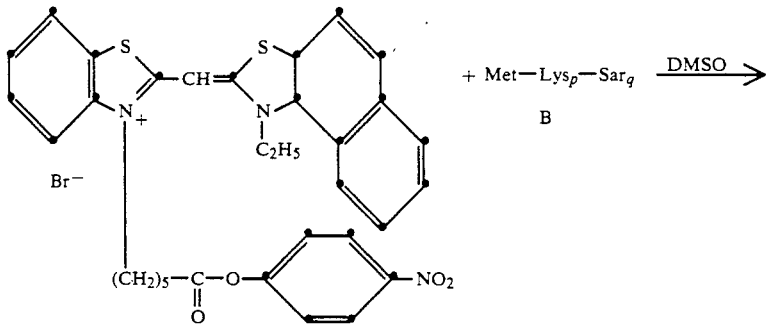

D

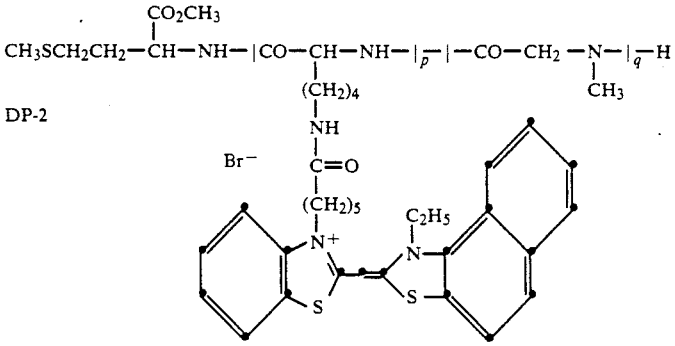

DP-2 p = 20 repeat units (about 13 of the lysine units were actually functionalized with dye)

q = 60 repeat units

The block copolypeptide (B) from step 3 (0.25 g, 0.7 meq. of amine groups) was dissolved in dimethyl sulfoxide (DMSO) and treated with the cyanine dye (D) from step 5 (0.5 g, 0.7 mmol) dissolved in DMSO, dropwise. The mixture was stirred 24 hours, filtered, and the product precipitated with anhydrous ethyl ether. The product was dissolved in water, dialyzed for 18 hours and freeze-dried.

Yield 0.5 g, 80%

$\lambda_{max}$ (MeOH) = 438 nm $E_{1\ cm}^{1\%} = 500$

By comparing the absorptivities of this dye-polymer and the corresponding monomeric dye, it was found that 13 out of the available amine groups per polymer chain were functionalized with dye molecules.

IR spectrum was found to be consistent with the assigned structure.

EXAMPLE 2

On an acetate support was coated a sulfur and gold sensitized silver bromoiodide emulsion (6.3 mole percent iodide) of mean grain size 0.85 μm at 1.08 g/m²Ag, 1.61 g/m² gelatin. 4-Hydroxy-6-methyl-1,3,3a,7-tetraazaindene, sodium salt was added at 1.74 g/Ag mole and 2-(2-octadecyl-5-sulfohydroquinone potassium salt at 12.9 mg/m². A dispersion of Coupler C-I (9% by weight) was added at 5.75 g/m². Additions sensitizing dyes and block copolypeptides and comparison materials described below were made, as indicated in Table III. A protective overcoat was applied at 1.61 g/m² gelatin, and the coating was hardened with bis(vinylsulfonyl)methane at 1.7% of the gelatin weight.

Coupler C-I

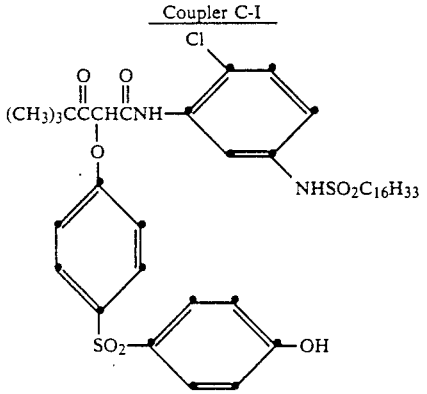

Monomeric sensitizing dye MD-1, anhydro-1,3'-bis(3-sulfopropyl)naptho[1,2-d]thiazolothiacyanine hydroxide, triethylamine salt was added as a solution in methanol, 1.0 mg/ml. Monomeric sensitizing dye MD-2, anhydro-5,5'dimethoxy-3,3'-bis(3-sulfo-propyl)-thiacyanine hydroxide, triethylamine salt was added as a solution in methanol, 1.70 mg/ml.

Dye polymers according to the invention, DP-1 and DP-2 were added to the emulsion as indicated below. DP-2 is identified in Example 1 and DP-1 is represented by the structure below.

DP-1

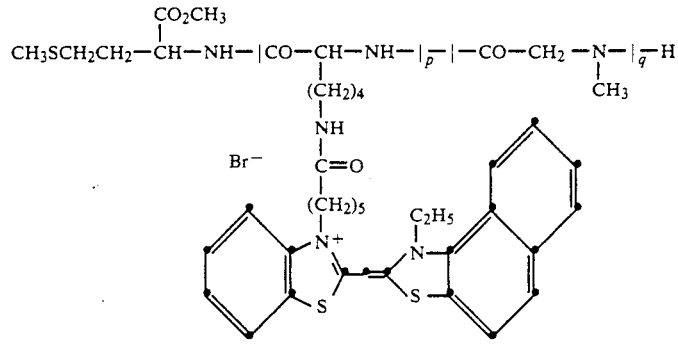

p = 20 repeat units (about 13 of the lysine units were actually functionalized with dye)
q = 80 repeat units The dye-polymers were added to the emulsion in the form of a dispersion. DP-1, 44 mg, was dissolved in 22 g 2-phenoxyethanol, and the solution was dispersed by stirring in a mixture of 91.2 g of 12.5% deionized bone gelatin and 76.8 g water at 40° C., followed by chill setting and noodle washing. The resulting dispersion contained 0.2 mg/g dispersion of dye polymer. The dispersion of DP-2 was prepared similarly, but using 38 mg DP-2, 38 g 2-phenoxyethanol, 91.2 g of 12.5 deionized bone gelatin, and 60.8 g water. The resulting dispersion contained 0.232 mg/g dispersion of dye polymer.

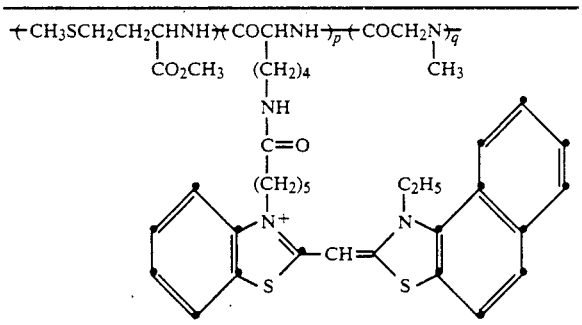

| Dye-Polymer Number | p* | q* | n* | No. of Dye Units Per Mole Polymer |
|---|---|---|---|---|
| DP-1 | 20 | 80 | 13 ± 1 | 13 ± 1 |
| DP-2 | 20 | 60 | 13 ± 1 | 13 ± 1 |

*p represents the theoretical number of lysine repeat units per block available for dye attachment, q represents the number of sarcosine repeat units per block, and n represents the number of lysine repeat units per block that were actually functionalized with dye, i.e., -B'-D units from formula (I).

Samples of the coatings were exposed through a graduated density scale for 0.02 s to a 5500° K. source (daylight exposure) and processed in the Kodak C41 ® processing, with development for 3 min 15 s at 38° C. The results are shown in Tables I and II.

TABLE I

| Coating Number | Intrinsic Speeds of Conventional Dyes and Dye Polymers<br>Dye (mg/Ag mole) | 365 Line Speed* | Δ 365L | Comments |
|---|---|---|---|---|
| 1 | None | 284 | — | Control |
| 2 | MD-1 (123) | 281 | −3 | Comparison |
| 3 | MD-1 (246) | 274 | −10 | Comparison |
| 4 | DP-2 (285) | 292 | +8 | Invention |
| 5 | DP-1 (282) | 291 | +7 | Invention |
| 6 | MD-1 (123) + DP-2 (285) | 291 | +7 | Invention |
| 7 | MD-1 (123) + DP-1 (282) | 289 | +5 | Invention |
| 8 | MD-1 (123) + DP-1 (141) | 288 | +4 | Invention |
| 9 | MD-2 (111) | 285 | +1 | Comparison |
| 10 | MD-2 (221) | 278 | −6 | Comparison |
| 11 | MD-2 (111) + DP-2 (285) | 289 | +5 | Invention |
| 12 | MD-2 (111) + DP-1 (282) | 290 | +6 | Invention |
| 13 | MD-2 (111) + DP-1 (141) | 283 | −1 | Invention |

*The 365 Line speeds reported in this Table are in Log E units × 100.

In Table I, an examination of the data for comparison Coatings 2, 3, 9, and 10 compared with that for undyed control Coating 1 shows that MD-1 and MD-2 decreased the intrinsic sensitivity (365 line speed). The decrease in intrinsic sensitivity was proportional to the amount of dye present. The dye polymers of the invention, on the other hand, surprisingly give substantial increases in the intrinsic sensitivity, as represented by the 365 line speed over the control Coating 1 as well as over Coatings 2, 3, 9, and 10 sensitized with the monomeric dyes.

TABLE II

| Coating Number | Spectral Speeds of Conventional Dyes and Dye Polymers<br>Dye (mg/Ag mole) | Spectral* Speed | Comments |
|---|---|---|---|
| 1 | None | — | Control |
| 2 | MD-1 (123) | 12 | Comparison |
| 4 | DP-2 (285) | 0 | Comparison |
| 5 | DP-1 (282) | 1 | Comparison |
| 6 | MD-1 (123) + DP-2 (285) | 19 | Invention |
| 7 | MD-1 (123) + DP-1 (282) | 17 | Invention |
| 8 | MD-1 (123) + DP-1 (141) | 14 | Invention |
| 9 | MD-2 (111) | 5 | Comparison |
| 11 | MD-2 (111) + DP-2 (285) | 14 | Invention |
| 12 | MD-2 (111) + DP-1 (282) | 17 | Invention |
| 13 | MD-2 (111) + DP-1 (141) | 15 | Invention |

*The spectral speeds reported in this Table are contributions to Daylight Wratten 2A speeds (in Log E units × 100) by the spectral sensitization of the dyes.

The data reported in Table II indicate that a combination of MD-1 or MD-2 with DP-1 or DP-2 provided increased spectral sensitization (compared to MD-1 or MD-2 alone) in addition to the intrinsic sensitization shown in Table I. This is especially surprising in view of the little or no spectral sensitization provided by the dye polymers alone.

The data of both Tables I and II illustrate the unexpected stability of the sensitized silver halide emulsion in the presence of a color coupler and a cationic cyanine dye.

Residual dye stain of the processed elements was evaluated by spectroscopic assessment. The data are presented in Table III below.

TABLE III

| Coating | Spectral Sensitizer (mg/Ag mole) | % Transmittance |
|---|---|---|
| 2 | MD-1 (123) | 77.5 |
| 11 | MD-2 (111) | 77.5 |
| 5 | DP-1 (282) | 75.0 |
| 4 | DP-2 (285) | 72.5 |
| 7 | MD-1 (123) + DP-1 (282) | 77.0 |
| 6 | MD-1 (123) + DP-2 (285) | 73.0 |
| 13 | MD-2 (111) + DP-1 (141) | 79.0 |

TABLE III-continued

| Coating | Spectral Sensitizer (mg/Ag mole) | % Transmittance |
|---|---|---|
| 12 | MD-2 (111) + DP-1 (282) | 72.5 |

The data in Table III show that DP-1. which had a greater proportion of the N-substituted amino acid -C- blocks than DP-2 (80 mole percent versus 60 mole percent), caused less residual dye stain in the photographic elements. Thus, the presence of the —C—blocks in dye polymers provides a means of reducing residual stain of processed photographic elements containing dye polymers. When the dye polymer of formula (I) is used in combination with a monomeric sensitizing dye, the residual dye stain can be further reduced to at least the dye stain from the monomeric dye alone (compare, e.g., Coatings 7 with 2, and 12 and 13 with 11). In some cases, e.g., Coating 13, the dye stain can be reduced to below the level of either the monomeric or polymeric dye alone.

The invention has been described in detail with particular reference to preferred embodiments thereof, but it will be understood that variations and modifications can be effected within the spirit and scope of the invention.

What is claimed is:

1. A photographic element comprising a support having thereon a silver halide emulsion sensitized with a dye polymer represented by the formula:

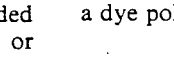

B represents a 1 to 100 repeat unit block of amino acid monomer wherein at least 1 of the repeat units in each block are represented by

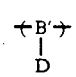

B′ represents an amino acid monomer repeat unit,

C represents a 1 to 100 repeat unit block of an N-substituted amino acid monomer, D is a dye capable of spectrally sensitizing silver halide, A represents a 1 to 100 repeat unit block of one or more other monomers, x represents a mole percent of 0 to 20%, y represents a mole percent of 1 to 50%, and z represents a mole percent of 50 to 99%.

2. A photographic element according to claim 1 wherein the B and B′ repeat units are an alpha amino acid.

3. A photographic element according to claim 1 wherein the B and B′ repeat units are selected from the group consisting of serine, theronine, tyrosine, hydroxy proline, aspartic acid, glutamic acid, lysine, arginine, ornithine, and histidine.

4. A photographic element according to claim 1 wherein the B and B′ repeat units are lysine.

5. A photographic element according to claim 1 wherein the C repeat units are selected from the group consisting of sarcosine, N-methyl valine, N-methyl phenylglycine, abrine, and surinamine.

6. A photographic element according to claim 1 wherein the C repeat units are sarcosine.

7. A photographic element according to any of claims 1–6 wherein the silver halide is also sensitized with a cyanine spectral sensitizing dye that is not attached to a polymer backbone.

* * * * *